US005826442A

United States Patent [19]

Lee

[11] Patent Number: 5,826,442

[45] Date of Patent: Oct. 27, 1998

[54] DEFROSTER FOR REFRIGERATORS

[75] Inventor: Jae-Hee Lee, Seoul, Rep. of Korea

[73] Assignee: Daewoo Electronics Co., Ltd., Rep. of Korea

[21] Appl. No.: 866,066

[22] Filed: May 30, 1997

[30] Foreign Application Priority Data

May 31, 1996 [KR] Rep. of Korea ..... 1996 18947

[51] Int. Cl.[6] ..... F25B 5/00

[52] U.S. Cl. ..... 62/283; 62/275

[58] Field of Search ..... 62/272, 275, 276, 62/283

[56] References Cited

U.S. PATENT DOCUMENTS

| | | | |
|---|---|---|---|
| 3,393,530 | 7/1968 | Koch | 62/275 |
| 3,786,227 | 1/1974 | Seipp et al. | 219/201 |
| 3,826,106 | 7/1974 | O'Hanlon | 62/275 |
| 3,872,683 | 3/1975 | Blanton . | |
| 4,077,229 | 3/1978 | Gelbard et al. | 62/283 |
| 4,345,441 | 8/1982 | Hansen . | |
| 4,543,799 | 10/1985 | Horvay et al. | 62/283 |
| 5,011,101 | 4/1991 | Buchser . | |
| 5,157,941 | 10/1992 | Cur . | |
| 5,255,536 | 10/1993 | Jung . | |
| 5,433,086 | 7/1995 | Cho et al. | 62/455 |
| 5,675,984 | 10/1997 | Shin | 62/276 |

*Primary Examiner*—William Doerrler

*Attorney, Agent, or Firm*—Cushman Darby & Cushman Intellectual Property Group of Pillsbury Madison & Sutro, LLP

[57] ABSTRACT

A defroster for refrigerators, capable of defrosting both a prefrosting panel and an evaporator using a defrosting heater, is disclosed. In an embodiment, a heat conduction panel integrally extends from the defrosting heater and terminates at a position approximate to one end of the prefrosting panel, thus allowing heat of the defrosting heater to be transferred to the prefrosting panel through thermal conduction. The heat conduction panel has an enough width to be connected to the total length of the defrosting heater and is uniformly spaced apart from the end of the prefrosting panel. In another embodiment, the prefrosting panel extends to an enough length to be directly connected to the defrosting heater, thus being selectively defrosted with heat transferred from the defrosting heater through thermal conduction.

3 Claims, 9 Drawing Sheets

DEFROSTER FOR REFRIGERATORS

BACKGROUND OF THE INVENTION

1. Field of the Invention

The present invention relates, in general, to a defroster for refrigerators and, more particularly, to a defroster used for restricting the frosting on the evaporators of freezer and refrigeration compartments of a refrigerator and defrosting the evaporators.

2. Description of the Prior Art

FIG. 1 is a view schematically showing the refrigeration system of a conventional home refrigerator. As shown in the drawing, the pressurized gas refrigerant discharged from a compressor 10 passes through in the order of an auxiliary heat dissipating pipe 11, hot pipe 12, back plate pipe 13 and wire condenser pipe 14, thus being changed into liquid refrigerant prior to being fed to a dryer 15 where moisture is removed from the refrigerant. The refrigerant discharged from the dryer 15 passes through a capillary tube 16 and flows into an evaporator 17 where evaporation proceeds at low pressure and consequent low temperature. The low pressure liquid refrigerant in the evaporator 17 is changed into the gas state by the addition of heat from surroundings, thus cooling the interior of the refrigerator. The gas refrigerant of the evaporator 17 returns to the compressor 10 by way of an accumulator 18 and accomplishes one refrigeration cycle. During the refrigerating operation of the refrigerator, such a refrigeration cycle is repeated.

If the refrigeration cycle is described in detail, the compressor 10 pressurizes the low pressure gas refrigerant and discharges high temperature pressurized gas refrigerant into the auxiliary heat dissipating pipe 11.

The above auxiliary heat dissipating pipe 11 is typically arranged inside an evaporation tray (not shown) positioned at the lower end of the refrigerator so that the hot gas refrigerant (70°–80° C.), discharged from the compressor 10 and flowing through the pipe 11, vaporizes the defrosting water inside the evaporation tray, which is obtained from the evaporator 17 by the defrosting operation.

A collateral effect of such an evaporation of the defrosting water is that the hot gas refrigerant in the pipe 11 somewhat dissipates heat into the defrosting water, thus be primarily cooled.

Thereafter, the refrigerant passes through the hot pipe 12. The hot pipe 12 is arranged in the refrigerator to pass the front part of the cabinet around the door so that the pipe 12 effectively prevents the dewing on the cabinet caused by the difference in temperature between the interior and exterior air of the refrigerator while opening the door of the refrigerator.

The refrigerant in turn passes through in the order of the back plate pipe 13 and the wire condenser pipe 14 thus being fully cooled and changed into the liquid state prior to being fed to the dryer 15.

While the refrigerant passes through the passage from the compressor 10 to the wire condenser pipe 14 and is fully cooled and liquidized, the resulting liquid refrigerant may be laden with moisture. The moisture is removed from the refrigerant by the dryer 15.

When the refrigerant with moisture is fed to the evaporator 17, the freezing and refrigerating effect of the refrigerator is remarkably reduced due to the difference in heat exchanging coefficient between the refrigerant and moisture. Therefore, the moisture has to be removed from the refrigerant before the refrigerant is fed to the evaporator 17.

The low temperature pressurized refrigerant free from moisture discharged from the dryer 15 is, thereafter, fed to the capillary tube 16.

In the capillary tube 16, adiabatic expansion proceeds under low pressure, thus quickly reducing the pressure of the refrigerant and reducing the temperature of the refrigerant to about −30° C.

The liquid refrigerant under low temperature and low pressure is quickly vaporized in the evaporator 17 while absorbing heat from surroundings, thus forming cool air for the freezer and refrigeration compartments of the refrigerator.

The accumulator 18 separates the liquid part from the vaporized refrigerant discharged from the evaporator 17 prior to feeding gas refrigerant to the compressor 10.

FIG. 2 is a side sectional view of a refrigerator, showing circulation of cool air in freezer and refrigeration compartments of the refrigerator.

As shown in FIG. 2, the cool air discharged from the evaporator 17 is introduced into both the freezer and refrigeration compartments 21 and 28 through 1st and 2nd air inlets 25 and 32, opening into the compartments 21 and 28, respectively. The two air inlets 25 and 32 communicate with a duct 27, which are provided in the cabinet of the refrigerator and receives the evaporator 17.

The 1st air inlet 25 for the freezer compartment 21 is provided with a fan 26 so that the cool air of the evaporator 17 is forcibly introduced into the freezer compartment 21.

After the cool air circulates in the freezer compartment 21, it returns to the evaporator 17 through a 1st air outlet 24, which is provided on the bottom of the freezer compartment 21. Meanwhile, the cool air of the refrigeration compartment 28 returns to the evaporator 17 through a 2nd air outlet 24, which is provided on the top of the refrigeration compartment 28. The return air is cooled again by the evaporator 17 prior to being fed into the two compartments 21 and 28. Such a circulation of cool air is repeated during the refrigerating operation of the refrigerator.

In this case, the air, returning from the two compartments 21 and 28 to the evaporator 17, is laden with moisture caused by both vaporization of food inside the two compartments 21 and 28 and introduction of moisture-laden external air into the compartments 21 and 28 while opening the doors 22 and 29 of the refrigerator. While the moisture-laden air passes by and is cooled by the evaporator 17, it frosts on the evaporator 17 and a layer of frost on the evaporator 17 is gradually thickened as time goes.

The layer of frost on the evaporator 17 acts as a thermal insulator, which prevents air from coming into direct contact with the evaporator 17, so that the evaporator 17 fails to fully cool the air and reduces the freezing and refrigerating effect of the refrigerator.

Therefore, it is necessary to defrost the evaporator timely in the refrigerator. In the prior art, various types of defrosters are proposed and used with refrigerators. In a home refrigerator, such a defrosting operation is performed by a defrosting heater 19, which is arranged at a position under the evaporator 17 as shown in FIG. 2.

The above defrosting heater 19 is selectively operated under the control of a microcomputer (not shown), which is programmed to control the heater 19 in accordance with data such as continuous operating time of the compressor 10 and temperature variation inside the refrigerator. The heater 19 is turned off in response to a defrosting end signal output from a defrosting sensor (not shown) installed in the evaporator 17.

FIG. 3 is a perspective view showing the construction of a conventional evaporator for refrigerators. As shown in FIG. 3, a refrigerant pipe 33 repeatedly extends horizontally and is bent into a zigzag configuration. Two of such zigzag pipes 33 are vertically arranged abroad in parallel and are paired into a set, with a plurality of cooling fins 34 individually having a rectangular thin plate configuration and being securely fitted over the pipes 22. The set of refrigerant pipes 33 with the cooling fins 34 is tightened by two rectangular side panels 35 and 36 at both sides around the bent portions of the pipes 33 thus forming a stable structure of an evaporator.

In the above evaporator, the cooling fins 34 on the same row are spaced out at regular intervals. However, the intervals of the fins 34 are different from each other in accordance with the rows of the pipes 33, with the fins 34 on the uppermost row being spaced most closely and the fins 34 on the lowest row being spaced most sparsely.

Such different intervals of the cooling fins 34 are to uniform the frost distribution on the evaporator 17 and improve operational efficiency while defrosting the evaporator 17.

That is, when evaporation proceeds at low pressure and consequent low temperature in the evaporator 17, air passes by the evaporator 17 upward so that it primarily frosts on the lower portion of the evaporator 17. When it frosts on an evaporator 17 with the cooling fins 34 being regularly spaced out regardless of rows of the pipes 33, there may be a heavy frost on the cooling fins 34 arranged on the lower portion of the evaporator 17, thus blocking the air passage defined between the fins 34 and reducing the air cooling efficiency of the evaporator 17. The heavy frost on the lower portion of the evaporator 17 also prevents heat transfer from the defrosting heater 19 to the evaporator 17 during a defrosting process, thus reducing operational efficiency while defrosting the evaporator 17. In order to overcome the problems, the cooling fins 34 on the evaporator 17 are spaced out at different intervals in accordance with the rows of the pipes 33 as described above.

However, the intervals between the cooling fins 34 on the lower portion of the evaporator 17 of FIG. 3 are enlarged by reducing the number of cooling fins 34 so that such an arrangement of the cooling fins 34 fails to prevent the thickening of a layer of frost at a position between neighboring rows of the pipes 33.

Particularly, the defrosting heater 19 is spaced apart from the lower end of the evaporator 17 by a distance, thus failing to achieve effective heat transfer or accomplish desirable defrosting effect. The above defrosting heater 19 defrosts the evaporator 17 with radiant heat so that the heater 19 is time consuming while defrosting.

In an effort to overcome the above problems, a refrigerator, with two longitudinal trapezoidal side panels 40 and 41 individually having a width being gradually enlarged from the top toward the bottom as shown in FIG. 4, is proposed and used. In addition, the bend portions of the refrigerant pipes 33 are fixed on both side edges of each side panel 40, 41.

In the above evaporator, the intervals between neighboring rows of the pipes 33 are gradually enlarged from the top toward the bottom so that it uniformly frosts on the evaporator.

The above evaporator has a defrosting heater 19, which is set in a hole formed at the lower center of each side panel 40, 41.

During a defrosting process, the above evaporator is defrosted by both radiant and conductive heat from the defrosting heater 19, with the conductive heat being directly transferred from the heater 19 to the side panels 40 and 41. The defrosting heater 19 of the above evaporator thus uniformly defrosts the evaporator with improved operational effect.

However, the defrosting heater 19, which is set in the hole of each side panel 40, 41, is problematic in that when air returns from the freezer and refrigeration compartments 21 and 28 to the evaporator 17 through the outlets 24 and 31 without being filtered, it heavily frosts on the evaporator 17 in a short time, thus requiring the defrosting operation frequently and reducing operational effect of the evaporator.

U.S. Pat. No. 3,872,683 discloses a defroster for refrigerators. The above defroster senses the amount of frost on the refrigerant pipes of an evaporator and selectively starts a defrosting heater. The gist of the above U.S. patent is the frost sensing unit rather than the defrosting unit.

In the evaporator disclosed in the above U.S. patent, the refrigerant pipe free from any cooling fin is arranged into a plurality of rows in the center of a duct, which guides return air from the freezer and refrigeration compartments onto the evaporator. A defrosting panel heater is installed at the lower portion of the refrigerant pipe and is selectively started in response to a frost sensing signal thus defrosting the refrigerant pipe of the evaporator.

The above defroster is advantageous in that the defrosting panel heater performs a defrosting process with heat emitted to the total area of the refrigerant pipe arranged inside the duct, thus effectively defrosting the total area of the evaporator quickly and simultaneously.

However, the return air discharged from the freezer and refrigeration compartments is directly guided to the evaporator without being filtered so that it quickly and heavily frosts on the evaporator 17 in a short time, thus rapidly reducing heat transfer rate between the refrigerant pipe and air and deteriorating operational effect of the evaporator while cooling the air.

Such a quick and heavy frosting on the evaporator 17 may be delayed by guiding the return air, discharged from the freezer and refrigeration compartments 21 and 28 through the outlets 24 and 31, to the top and bottom sides of a prefrosting panel 20 as shown in FIG. 5, thus primarily frosting on the panel 20 and reducing the amount of moisture in the return air for the evaporator 17.

The above prefrosting panel 20 is arranged horizontally in the duct 27, defined in the partition wall between the two compartments 21 and 28, so that the return air discharged from the two compartments 21 and 28 is guided to the evaporator 17 while flowing on both sides of the panel 20.

Therefore, the amount of frost on the prefrosting panel 20 increases in proportion to the difference ($T_1-T_2=\Delta T$) in temperature between the top and bottom sides of the panel 20 on which the return air discharged from the freezer and refrigeration compartments 21 and 28 flows to the evaporator 17. In other words, the amount of frost on the prefrosting panel 20 is in proportion to the difference in temperature between the return air discharged from the freezer and refrigeration compartments 21 and 28.

In order to increase the amount of frost on the prefrosting panel 20, It is necessary to increase the temperature difference between both sides of the prefrosting panel 20.

A heating wire 44 is arranged in the prefrosting panel 20 as shown in FIG. 6. The heating wire 44 is selectively turned on in accordance with the amount of frost on the panel 20, thus defrosting the panel 20.

However, the above defroster, with both the prefrosting panel 20 delaying the frosting on the evaporator 17 and the defrosting heater 19 being used for selectively defrosting the evaporator 17, is problematic in that the heating wire 44 has to be arranged in the prefrosting panel 20, thus complicating the construction of the defroster and increasing production costs.

SUMMARY OF THE INVENTION

Accordingly, the present invention has been made keeping in mind the above problems occurring in the prior art, and an object of the present invention is to provide a defroster for refrigerators, which defrosts both a prefrosting panel and an evaporator using a defrosting heater, thus removing the typical heating wire from the prefrosting panel and simplifying the construction, and reducing production costs.

In accordance with an embodiment, the present invention provides a defroster for refrigerators, comprising a prefrosting panel adapted for guiding return air discharged from freezer and refrigeration compartments of a refrigerator to an evaporator while causing it to primarily frost on the panel thus reducing the amount of frost on the evaporator and delaying the frosting on the evaporator, and a defrosting heater adapted for selectively defrosting the evaporator, further comprising: a heat conduction panel integrally extending from the defrosting heater and terminating at a position approximate to one end of the prefrosting panel, thus allowing heat of the defrosting heater to be transferred to the prefrosting panel through thermal conduction.

In accordance with another embodiment, the invention provides a defroster for refrigerators, comprising a prefrosting panel adapted for guiding return air discharged from freezer and refrigeration compartments of a refrigerator to an evaporator while causing it to primarily frost on the panel thus reducing the amount of frost on the evaporator and delaying the frosting on the evaporator, and a defrosting heater adapted for selectively defrosting the evaporator, wherein the prefrosting panel extends to an enough length to be directly connected to the defrosting heater, thus being selectively defrosted with heat transferred from the defrosting heater through thermal conduction.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
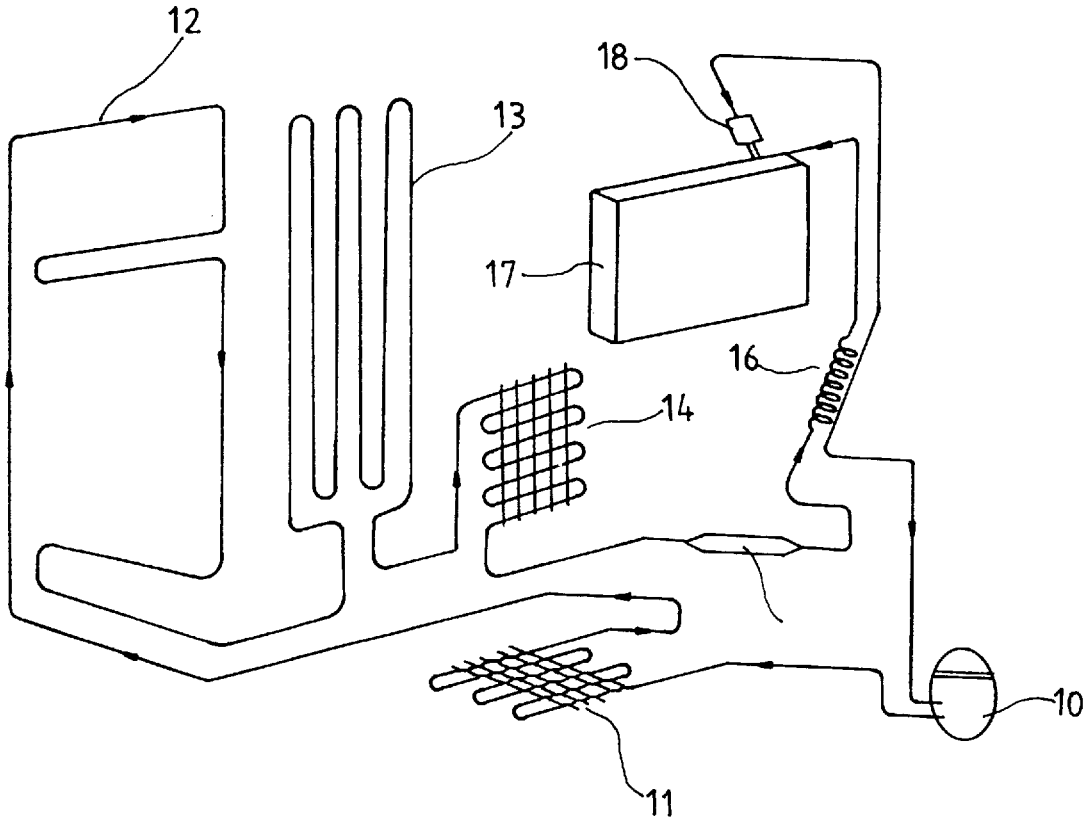
PRIOR ART FIG. 1
FIG. 1 is a view schematically showing the refrigeration system of a conventional home refrigerator.
Figure 2:
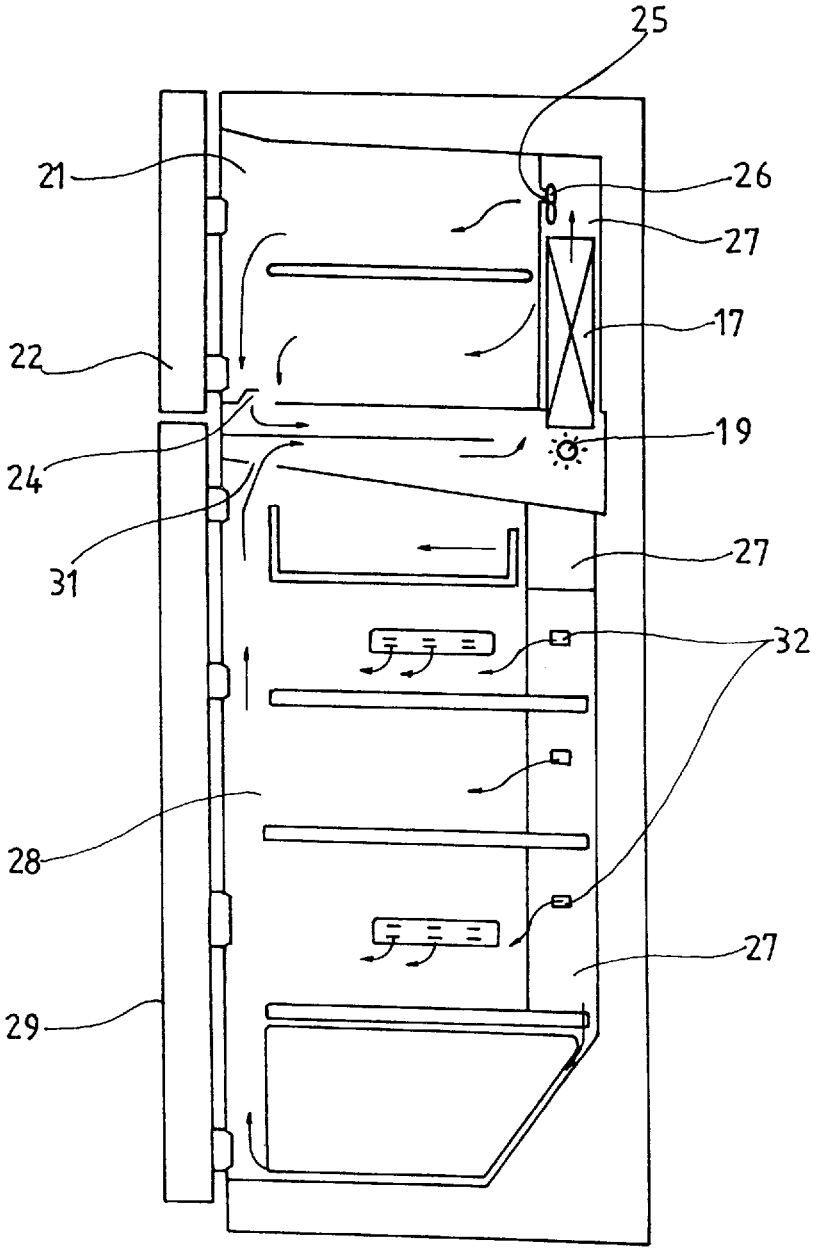
PRIOR ART FIG. 2
FIG. 2 is a side sectional view of a typical refrigerator, showing circulation of cool air in the freezer and refrigeration compartments of the refrigerator.
Figure 3:
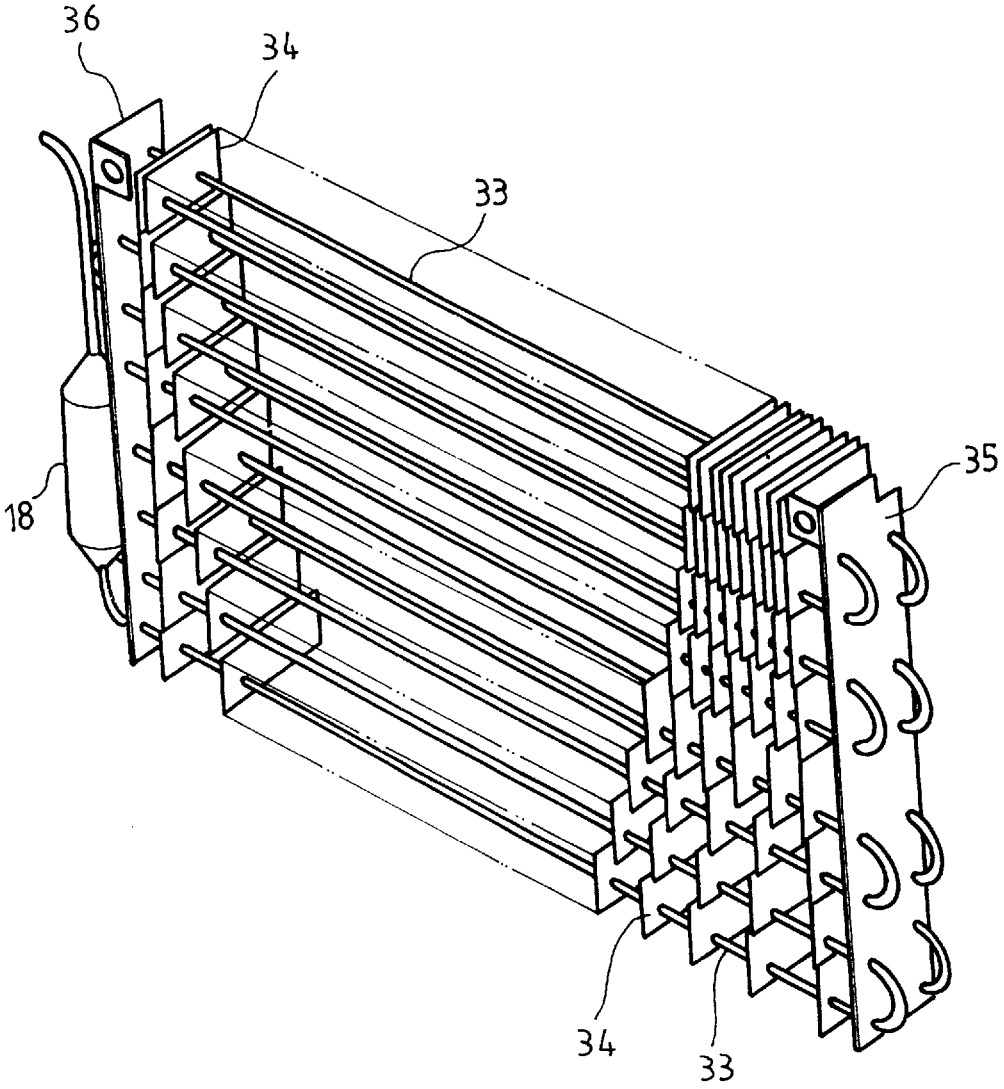
PRIOR ART FIG. 3
FIG. 3 is a perspective view showing the construction of a typical evaporator for refrigerators.
Figure 4:
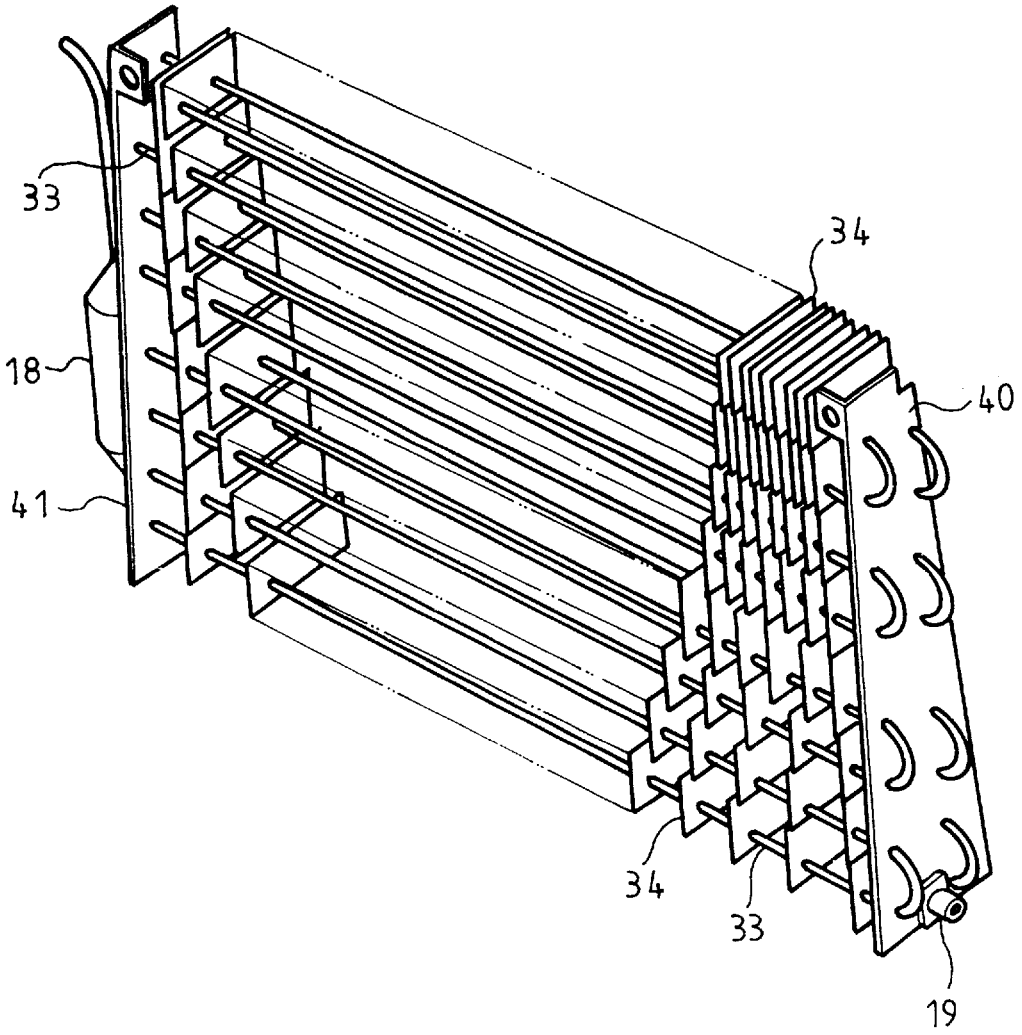
PRIOR ART FIG. 4
FIG. 4 is a perspective view showing the construction of a typical evaporator according to another embodiment of the prior art, with a defrosting heater being integrated with the evaporator into a single body and a trapezoidal side panel suitable for uniform frosting on the evaporator.
Figure 5:
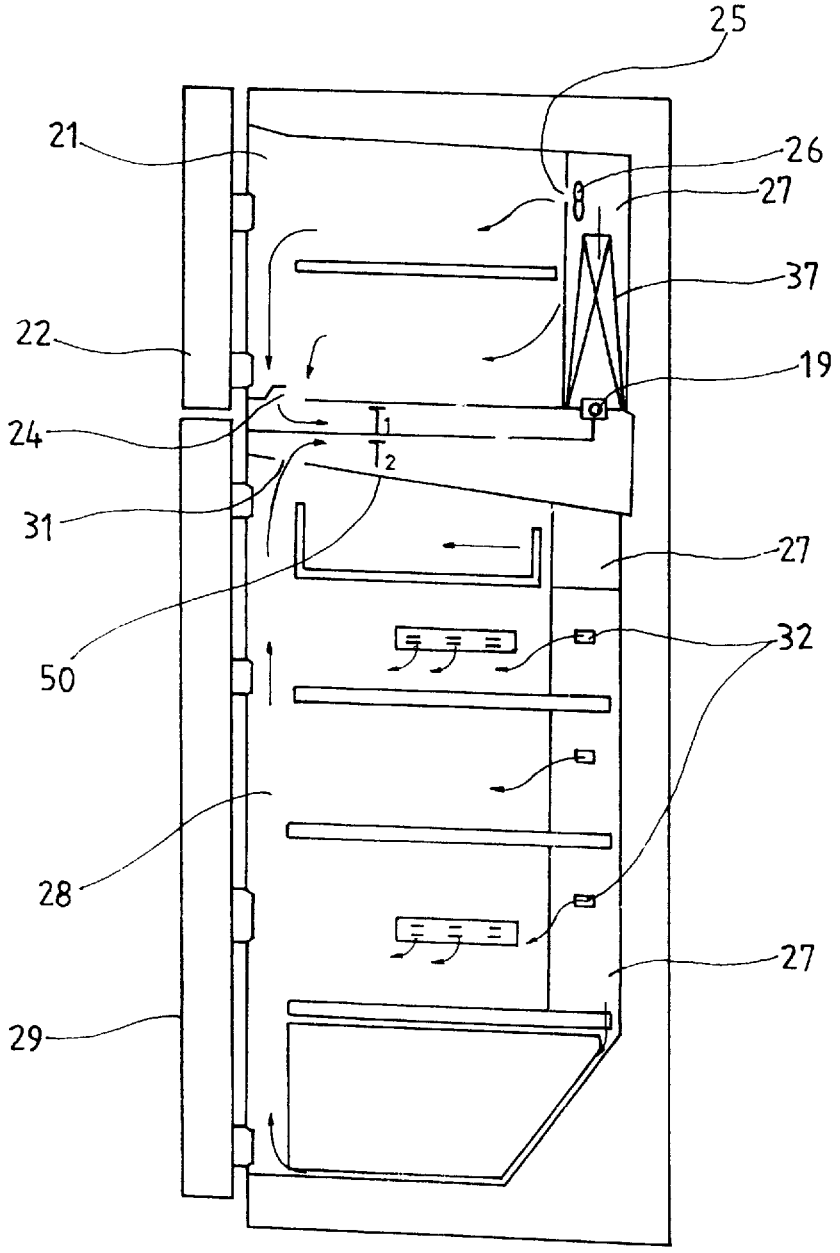
PRIOR ART FIG. 5
FIG. 5 is a side sectional view of a refrigerator with a typical prefrosting panel, showing circulation of cool air in the refrigerator.
Figure 6:
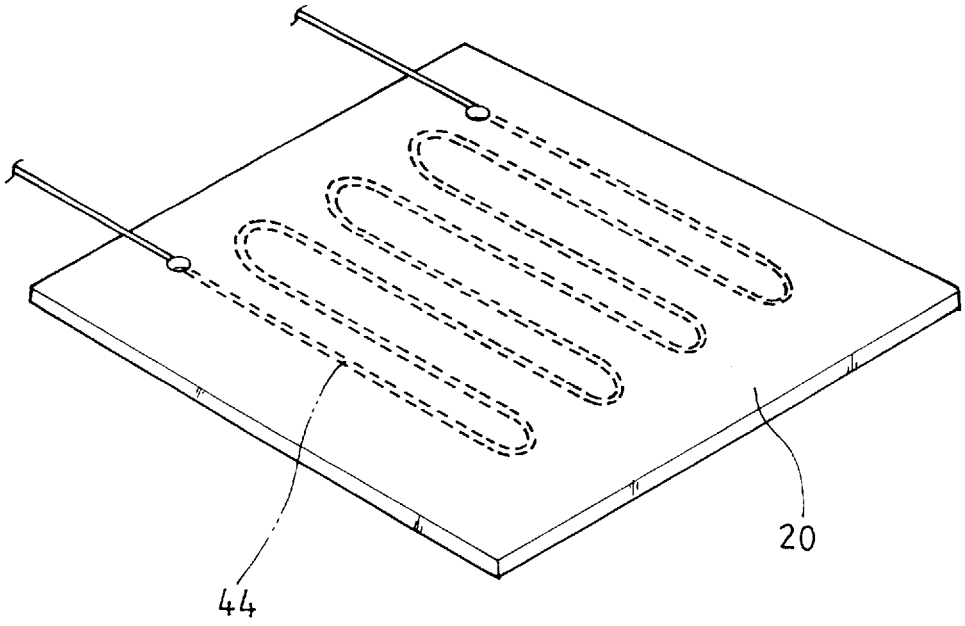
PRIOR ART FIG. 6
FIG. 6 is a perspective view of a conventional prefrosting panel.
Figure 7:
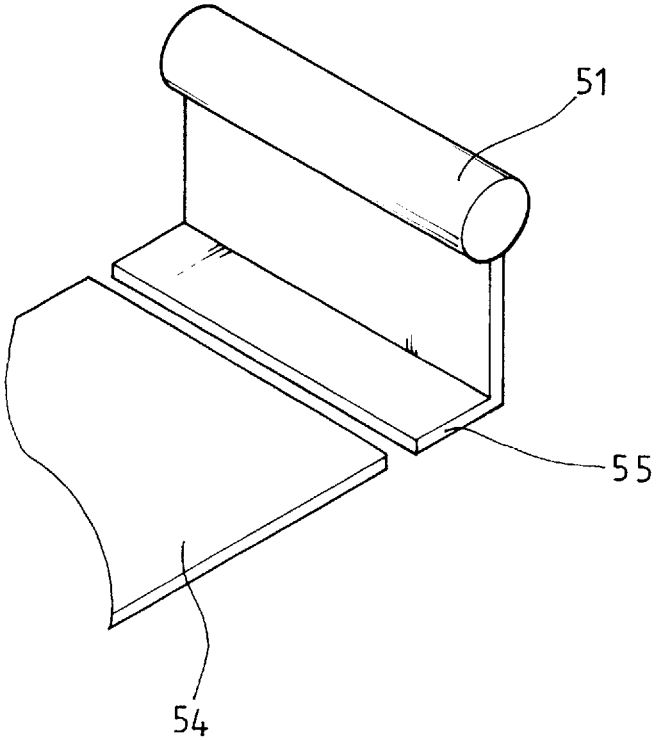
FIG. 7 is a perspective view of a defroster according to the primary embodiment of the present invention.
Figure 8:
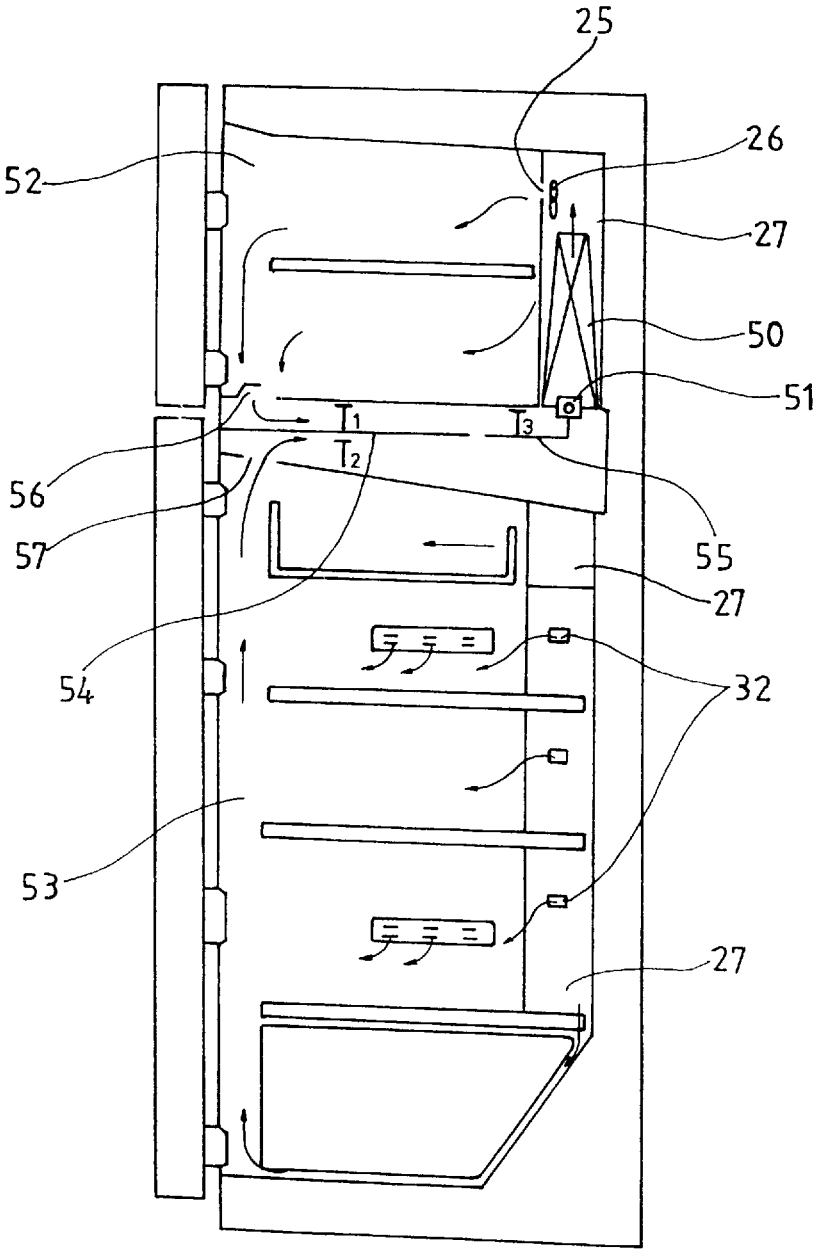
FIG. 8 is a side sectional view of a refrigerator with the defroster of this invention, showing circulation of cool air in the refrigerator.

FIGS. 7 and 8 show a defroster according to the primary embodiment of the present invention and a refrigerator equipped with the defroster, respectively. As shown in the drawings, a defrosting heater 51 is installed in the lower end of an evaporator 50 and is originally used for defrosting the evaporator 50. A prefrosting panel 54 is arranged horizontally in the duct 27, defined in the partition wall between freezer and refrigeration compartments 52 and 53, so that the return air discharged from the two compartments 52 and 53 is guided to the evaporator 50 while flowing on both sides of the panel 54. The defroster of this invention also has a heat conduction panel 55. The heat conduction panel 55 integrally extends from the defrosting heater 51 and terminates at a position approximate to one end of the prefrosting panel 54, thus allowing heat of the defrosting heater 51 to be transferred to the prefrosting panel 54 through thermal conduction.

In order to smoothly and effectively transfer heat from the defrosting heater 51 to the prefrosting panel 54, the heat conduction panel 55 has an enough width to be connected to the total length of the defrosting heater 51 and is uniformly spaced apart from the end of the prefrosting panel 54.

The operational effect of the above defroster will be described hereinbelow.

When letting the temperature of return air, discharged from the freezer compartment 52 through an outlet 56 and flowing on the top side of the prefrosting panel 54, be $T_1$ and letting the temperature of return air, discharged from the refrigeration compartment 53 through an outlet 57 and flowing on the bottom side of the prefrosting panel 54, be $T_2$, the temperature relation of return air on both sides of the prefrosting panel 54 is represented by $T_1<T_2$.

Therefore, the prefrosting panel 54 is cooled by the return air discharged from the freezer compartment 52 so that the temperature of the panel 54 is reduced to a point of close to $T_1$ and lower than $T_2$. Therefore, the prefrosting panel 54 absorbs heat from the moisture-laden return air discharged from the refrigeration compartment 53 so that it frosts on the prefrosting panel 54.

When a predetermined amount of frost is deposited on the prefrosting panel 54 or on the evaporator 50, the defrosting heater 51 is started in a conventional manner thus defrosting both the panel 54 and the evaporator 50.

That is, when the heater 51 is started, heat of the heater 51 is transferred to the evaporator 50 thus defrosting the evaporator 50. Heat of the defrosting heater 50 is also transferred to the prefrosting panel 54 through the heat conduction panel 55, thus defrosting the prefrosting panel 54. The defroster of this invention thus effectively defrosts the prefrosting panel 54 without installing any heating wire in the panel 54 thus having a simple construction.

Figure 9:
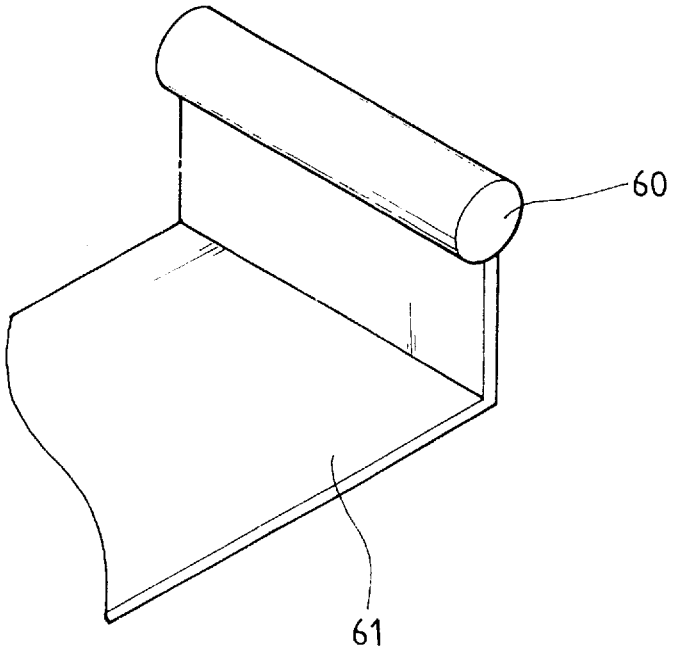
FIG. 9 is a perspective view of a defroster according to another embodiment of the present invention.

FIG. 9 is a perspective view of a defroster according to another embodiment of the present invention. In the defroster according to the embodiment, the prefrosting panel 61, on which it primarily frosts due to the difference in temperature between the return air discharged from the freezer and refrigeration compartments thus reducing the amount of frost on an evaporator, extends to an enough length to be directly connected to a defrosting heater. The above defroster thus more effectively defrosts the prefrosting panel 61 with heat transferred from the defrosting heater 60 through thermal conduction.

As described above, the present invention provides a defroster for refrigerators, which defrosts both a prefrosting panel and an evaporator using a defrosting heater. The defroster of this invention removes the typical heating wire from the prefrosting panel and simplifies the construction of a refrigerator with a reduced number of elements, thus improving work efficiency and productivity and reducing production costs while producing refrigerators. Another advantage of the defroster of this invention resides in that it saves electric power.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A defroster for refrigerators comprising a prefrosting panel adapted for guiding return air discharged from freezer and refrigeration compartments of a refrigerator to an evaporator while causing it to primarily frost on the panel thus reducing the amount of frost on the evaporator and delaying the frosting on the evaporator, and a defrosting heater adapted for selectively defrosting the evaporator, further comprising:

heat conduction panel integrally extending from said defrosting heater and terminating at a position approximate to one end of said prefrosting panel, thus allowing heat of the defrosting heater to be transferred to the prefrosting panel through thermal conduction.

2. The defroster according to claim 1, wherein said heat conduction panel has an enough width to be connected to the total length of said defrosting heater and is uniformly spaced apart from the end of said prefrosting panel.

3. A defroster for refrigerators comprising a prefrosting panel adapted for guiding return air discharged from freezer and refrigeration compartments of a refrigerator to an evaporator while causing it to primarily frost on the panel thus reducing the amount of frost on the evaporator and delaying the frosting on the evaporator, and a defrosting heater adapted for selectively defrosting the evaporator, wherein said prefrosting panel extends enough to be directly connected to said defrosting heater, thus being selectively defrosted with heat transferred from the defrosting heater through thermal conduction.

* * * * *